United States Patent [19]

Fairbairn et al.

[11] 4,433,482

[45] Feb. 28, 1984

[54] METHOD OF MAKING AN ELECTRICAL CONTACT

[75] Inventors: Leroy W. Fairbairn, Sidney; Clifford R. Waldron, Niverville, both of N.Y.

[73] Assignee: The Bendix Corporation, Southfield, Mich.

[21] Appl. No.: 324,714

[22] Filed: Nov. 24, 1981

Related U.S. Application Data

[63] Continuation of Ser. No. 84,959, Nov. 15, 1979, abandoned.

[51] Int. Cl.[3] ..... H01R 43/04

[52] U.S. Cl. ..... 29/882; 29/283.5; 29/520

[58] Field of Search ..... 29/268, 882, 520, 283.5; 72/409, 402, 410; 81/5.1 R, 5.1 B, 418, 425 R, 425 A, 426

[56] References Cited

U.S. PATENT DOCUMENTS

| | | | |
|---|---|---|---|
| 1,272,700 | 7/1918 | Newcomb . | |
| 2,060,864 | 11/1936 | Hedler | 29/520 X |
| 2,211,537 | 8/1940 | Dickinson | 29/520 X |
| 2,340,360 | 1/1944 | Alden . | |
| 3,304,602 | 2/1967 | Osborne . | |
| 3,491,577 | 1/1970 | Lingenbrink | 72/410 X |
| 3,509,617 | 5/1970 | Winter . | |
| 3,725,844 | 4/1973 | McKeown et al. . | |
| 3,824,665 | 7/1974 | Saito | 29/283.5 X |
| 4,072,394 | 2/1978 | Waldron et al. . | |
| 4,082,398 | 4/1978 | Bourdon et al. . | |
| 4,157,806 | 6/1979 | Bourdon et al. . | |

*Primary Examiner*—Howard N. Goldberg
*Assistant Examiner*—Carl J. Arbes
*Attorney, Agent, or Firm*—C. D. Lacina; R. J. Eifler; K. A. Seaman

[57] ABSTRACT

An improved method of making a retention collar (16) medially of an elongated electrical contact (10) of the type including a shoulder portion (14) and a termination portion (18), the shoulder portion (14) being formed with an axial passage (22) sized to secure several straight conductive wires (24) for mating. The individual wires are inserted into the passage and the shoulder portion then swaged (i.e., squeezed) by a pair of movable dies (36, 46) in an axial direction along the entire length of the passage so that an outer wall portion of the shoulder portion is pushed axially rearwardly and radially outwardly to thereby form the retention collar (16) and also pushed radially inwardly to thereby secure the wires within the passage.

8 Claims, 5 Drawing Figures

METHOD OF MAKING AN ELECTRICAL CONTACT

This application is a continuation of Application Ser. No. 84,959, filed Nov. 15, 1979 and now abandoned.

TECHNICAL FIELD

This invention relates to methods for making electrical contacts and, in particular, to methods for securing axially aligned electrical conducting fine wires within the axial passage of a contact holder.

BACKGROUND ART

Prior patents disclose an electrical brush contact intended to have fine wires inserted into a barrel and crimped to comprise a contact. For example, the U.S. patent of McKeown et al, U.S. Pat. No. 3,725,844 discloses a hermaphroditic electrical contact wherein seven or more wires are crimped at one or more positions to secure the wires within the inner portion of a passage formed therein. As suggested in the above patent, the wires could be soldered or brazed into position so long as the wires are in electric circuit relationship with one another. The crimping operation may be performed by a well-known plier type tool that, when squeezed, applies pressure simultaneously to two pairs of diametrically opposed points of the contact to conform the contact wall to the wires within the contact.

Each of the contacts and the wires associated with such a contact are quite small (the contacts being about one-half of an inch long with a diameter of about 0.092 inches). Generally, electrical contacts are machined from metal stock and, because of their small size, the contacts are machined to tolerances of 0.002 inches or less. A contact which is oversize for any reason cannot be utilized because it may not be possible to insert such a contact into the contact receiving holes of a connector insert, or insufficient clearance between contacts could cause electrical and mechanical problems. Also, because such electrical contacts are generally machined from metal stock, the largest desired diameter of the finished contact determines the smallest diameter that the metal stock can be.

Machining of electrical contacts is expensive and because of the large number of contacts utilized by a connector and the attendant material costs, the connector is relatively expensive. Therefore, to reduce the cost of manufacturing a connector, material and machining costs should be kept to a minimum. Also, the cost of manufacturing the connector can obviously be reduced if the number of manufacturing steps to produce a contact is also reduced to thereby provide further savings. At the same time, the fine wires of the contact must be secured within the contact holder in such a way as to provide a good electrical and mechanical connection therebetween.

DISCLOSURE OF THE INVENTION

An object of the present invention is to provide an electrical contact that is simple in construction and economical to manufacture.

Another object of this invention is to replace expensive machined electrical contacts with inexpensive electrical contacts wherein axially aligned fine wires are secured within the axial passage of the contact holder by pressure swaging the holder from the forward end of the passage toward the rear end of the passage in an axial direction.

A further object of the invention is to provide an electrical contact wherein several axially aligned fine wires are secured within an axial passage of the contact holder and a retention collar is formed in one manufacturing step.

It is still another object of the invention to provide an electrical contact wherein several axially aligned fine wires are secured within an axial passage of a contact holder along substantially the entire length of the axial passage to thereby provide a secure mechanical and electrical connection between the wires and the contact holder.

It is yet another object of the present invention to provide an electrical contact having a retention collar wherein the diameter of the retention collar is larger than the diameter of the metal stock from which the electrical contact is formed.

In carrying out the above objects and other objects of this invention, a preferred method of making an electrical contact (10) comprising a holder (12) including an axial passage (22) having a forward end portion (35) and a rear end portion (30) and several electrical conducting wires (24) axially aligned and axially mounted within the passage, comprises the steps of: inserting the wires into the axial passage and swaging the holder from the forward end portion of the passage towards the rear end portion (30) of the passage in an axial direction to secure the inserted wires within the passage.

In further carrying out the above objects and other objects of this invention, another preferred method of making an electrical contact comprising a holder having a cylindrical shoulder portion formed with an axial passage having a forward end portion and a rear end portion, several electrical conducting wires axially aligned and axially mounted within the passage and a rear termination portion 18, comprises: inserting the wires into the passage, positioning the mating portion of the contact and swaging the shoulder portion of the holder from the forward end portion of the passage along the entire length of the passage towards the rear end portion of the passage in an axial direction so that as the shoulder portion is pushed axially rearwardly towards the rear termination portion, an outer wall portion is pushed radially outwardly to thereby form medially of the holder a retention collar and an inner wall portion of the shoulder portion defining the axial passage is pushed radially inwardly to thereby secure the wires within the passage.

The objects, features and advantages of the present invention are readily apparent from the following detailed description of the best mode taken in connection with the accompanying drawings.

BEST MODE FOR CARRYING OUT THE INVENTION

Figure 1:
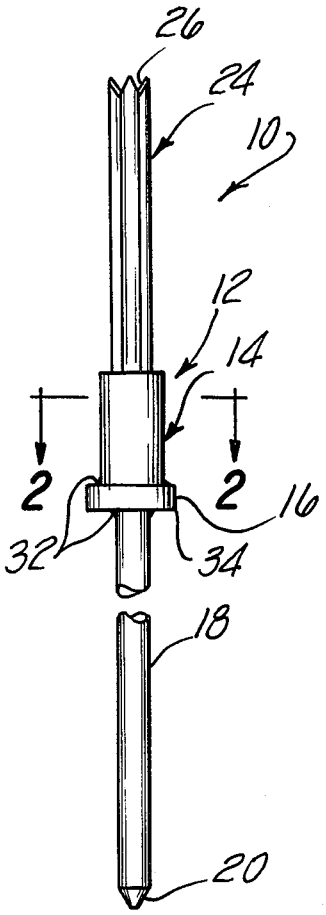
FIG. 1 is a side elevational view, partially broken away, of a finished electrical contact constructed according to the method of this invention.

Referring to FIG. 1, a finished elongated electrical contact generally indicated at 10 is shown constructed according to the method of the present invention. The contact 10 comprises a holder generally indicated at 12 which has a shoulder portion generally indicated at 14, an integrally formed retention collar 16 and an integrally formed rear termination portion 18 having a tapered end 20. The shoulder portion 14 has an axial passage generally indicated at 22 formed through the center of the shoulder portion 14 such as by drilling or extruding.

The contact 10 also includes several electrical conducting fine brush wires generally indicated at 24, preferably comprising seven in number, and which are axially aligned and axially mounted within the passage 22 as described in greater detail hereinafter.

Figure 3:
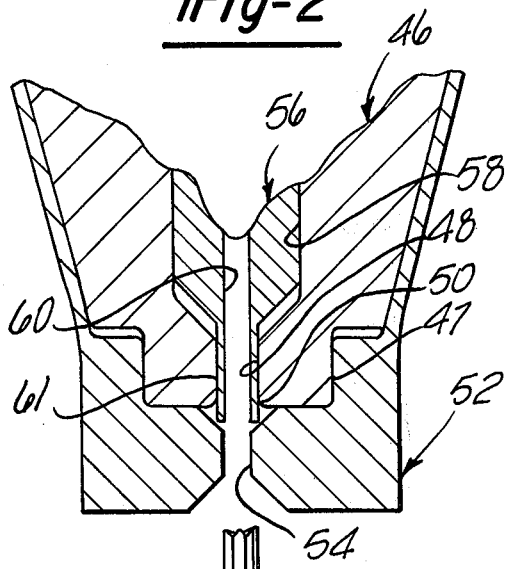
FIG. 3 is a sectional view, partially broken away, illustrating the method of the present invention.
Figure 3:
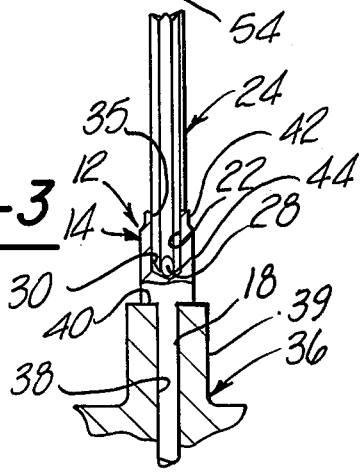

As described in the McKeown et al patent U.S. Pat. No. 3,725,844, which patent is hereby incorporated herein by reference, the ends of the wires 24 have tapered or angled opposite end surfaces 26 and 28, as shown in FIGS. 1 and 3, respectively, to facilitate sliding movement upon contact with the wires from another contact (not shown). An example of one preferred material for the wires 24 is beryllium copper wire having a silver coating thereon.

In the preferred embodiment the finished shoulder portion 14 has an outside diameter of about 0.039 inches, the passage 22 is 0.060 inches in length and the shoulder portion 14 has an axial length of approximately 0.085 inches. In this embodiment, the wires 24 have a diameter less than 0.01 inches and greater that 0.001 inches. Preferably, the wires 24 have a length of about 0.15 inches and a diameter of about 0.008 inches.

Preferably, the shoulder portion 14 consists of bronze or other copper alloy having a plating of tin, copper, or silver to provide the shoulder portion 14 with good electrical current carrying characteristics.

A cross-hole which would ordinarily communicate the rear end portion 30 of the passage 22 to the exterior of the contact 10 for fluid plating purposes, is not required since the ratio of the diameter of the passage 22 to the length or depth of the passage 22 prevents the plating fluid from being trapped within the passage 22.

The retention collar 16 preferably has an outer diameter of 0.058 inches and a width of about 0.015 inches. The interconnecting surfaces between the retention collar 16 and the shoulder portion 14, and the termination portion 18 and the retention collar 16 are slightly rounded at 32. Also, the forward, outer edge surface of the retention collar 16 is slightly rounded at 34.

The retention collar 16 is provided to allow the contact 10 to be retained in a connector molding or insert (not shown) which may have flexible retention fingers to hold the retention collar 16 therebetween. Such connector moldings or inserts are shown in the U.S. patent to Bourdon et al U.S. Pat. No. 4,082,398 and the U.S. patent to Bourdon et al U.S. Pat. No. 4,157,806, both of which have the same assignee as the present application and both of which are hereby incorporated herein by reference.

The termination portion 18 allows the contact 10 to be terminated or connected to a printed circuit board or to a mother or daughter board in a conventional fashion.

The electrical contact 10 shown in FIG. 1, which is commonly referred to as a hermaphroditic contact, could also be considered to be a "male" contact, may be converted or made into a "female" contact by sliding a stainless steel sleeve concentrically over the shoulder portion 14 so that the sleeve extends beyond the end surfaces 26 of the wires 24. Such a removable sleeve is shown in the U.S. patent to Waldron et al U.S. Pat. No. 4,072,394 having the same assignee as the present application and which is also hereby incorporated herein by reference.

Figure 2:
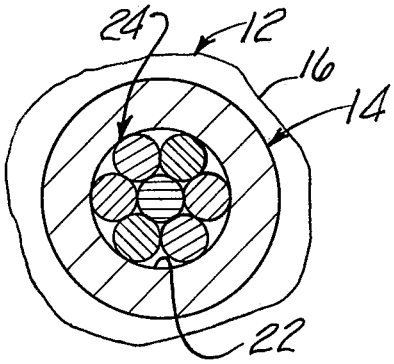
FIG. 2 is a sectional view of the contact taken along line 2—2 of FIG. 1, slightly enlarged for illustrative purposes.
Figure 4:
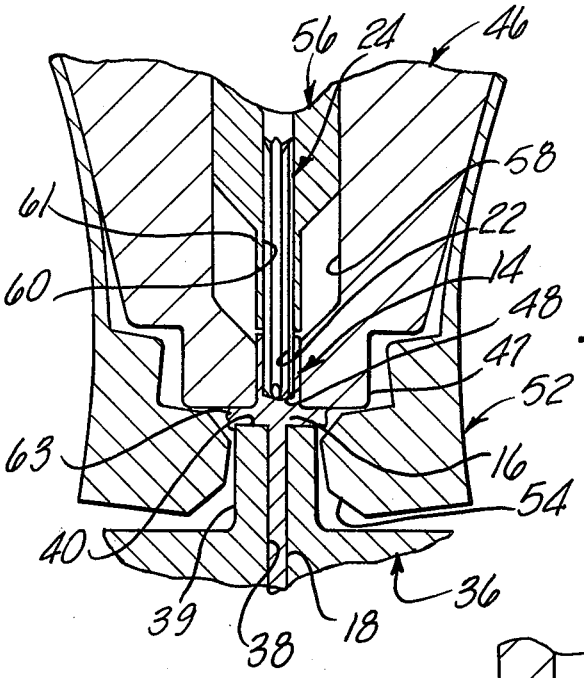
FIG. 4 is a sectional view, partially broken away, illustrating the method of the present invention.
Figure 5:
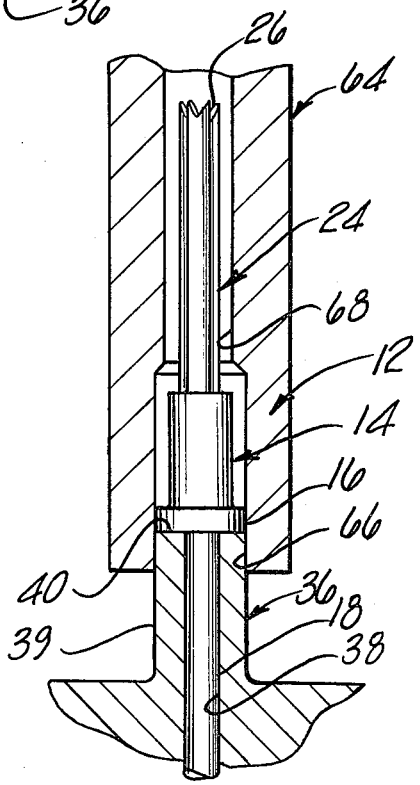
FIG. 5 is a sectional view, partially broken away, illustrating the method of the present invention.

Referring now to FIGS. 3 through 5, there is illustrated a preferred method of making the electrical contact 10 of FIGS. 1 and 2. The wires 24 are inserted into the forward end portion 35 of the passage 22 of the holder 12 so that the inserted ends of the wires 24 extend to the rear end portion 30 of the passage 22. The holder 12 is positioned on a base die generally indicated at 36 so that the termination portion 18 of the holder 12 is disposed within an axial hole 38 formed in a cylindrical portion 39 of the base die 36 and so that the shoulder portion 14 rests on a top, active or working surface 40 of the cylindrical portion 39.

The preformed shoulder portion 14, as shown in FIG. 3, is preferably either turned or extruded from metal stock and includes a tapered end portion 42 of reduced diameter and a cylindrical portion 44. Preferably, the end portion 42 has an outer diameter of 0.040 inches, the cylindrical portion 44 has an outer diameter of 0.048 inches, and the passage 22 has a diameter of 0.029 inches.

The base die 36 is positioned opposite a forming die generally indicated at 46 so that the wires 24 are aligned with an aperture 48 formed through a collar portion 47 of the forming die 46. The forward opening 50 of the aperture is defined by rounded surfaces of the collar portion 47 so that the wires 24 may be easily inserted therethrough.

Concentrically disposed about the forming die 46 is an expandable alignment collet generally indicated at 52 which has an inwardly tapered opening 54 for guiding the ends of the wires 24 into the aperture 48. An extendable and retractable knockout generally indicated at 56 is slidably disposed within an axial bore 58 formed in the forming die 46. The knockout 56 has an axial bore 60 extending therethrough and includes an integral, axially extending cylindrical portion 61 for engaging the shoulder portion 14 at its end portion 42, as will be described in greater detail hereinafter.

Referring now to FIG. 4, the dies 36 and 46 are moved towards each other so that the wires 24 move upwardly into the hole 60. The aperture 48 of the forming die 46 is slightly smaller (on the order of one-thousandth of an inch) than the outer diameter of the end portion 42 of the shoulder portion 14. Therefore, as the dies 36 and 46 are moved together, the rounded surfaces of the collar portion 47 defining the opening 50 engage the end portion 42 and subsequently, the cylindrical portion 44 of the shoulder portion 14, and are pushed or squeezed radially inwardly to secure the wires 24 within the axial passage 22. At the same time, the end portion 42 of the shoulder portion 14 moves the knockout 56 axially inwardly in the bore 58, and the flexible alignment collet 52 moves radially outwardly to allow the passage of the cylindrical portion 39 of the die 36 upwardly into the opening 54.

The forming die 46 and the base die 36 swage the shoulder portion 14 of the holder 12 by cold working the shoulder portion 14 to reduce the outer diameter of the shoulder portion 14 to substantially equal the diameter of the aperture 48 of the forming 46 which, in the preferred embodiment, is 0.039 inches.

As the two dies 46 and 36 move further together, the cylindrical portion 39 of the die 46 pushes the outermost circumferential layer or outer wall portion of the shoulder portion 14 in an axial direction towards the termination portion 18 so that an outer wall portion is pushed radially outwardly to form the retention collar 16. The formed retention collar 16 has a rough outer circumferential layer 63 which is later trimmed, as will be described in greater detail hereinafter.

After the shoulder portion 14 of the holder 12 has been swaged by cold working, the knockout 56 is extended outwardly in an axial direction so that the cylindrical portion 61 engages the axially aligned end portion 42 of the shoulder portion 14 to thereby push or knock out the holder 12 from within the aperture 48.

Referring now to FIG. 5, the rough outer circumferential layer 63 of the retention collar 16 is trimmed or cut off by a trimming die, generally indicated at 64, and the base die 36. The holder 12, which is still positioned on the base die 36, is moved into an axial bore 66 of the trimming die 64 which has a diameter slightly larger than the outer diameter of the cylindrical portion 39 to thereby trim off the outer circumferential layer 63 of the retention collar 16 which extends over the sides of the cylindrical portion 39 of the base die 36. The trimming die 64 also includes a second axial bore 68 of reduced diameter to allow the wires 24 to extend upwardly into the trimming die 64 during the trimming operation. The finished contact 10 is then removed from the base die 36.

While a preferred embodiment of an improved method of securing wires within an axial passage of a contact holder has been described herein in detail, those skilled in this arrt will recognize various alternative designs and embodiments for practicing the present invention as defined by the following claims.

What is claimed is:

1. A method of forming a medial collar portion on an electrical contact, the steps of the method comprising:

providing a holder (12) having first and second generally cylindrical end portions (18, 14), the second end portion (14) formed with an axially inwardly extending passage (22), providing a plurality of axial wires (24), inserting the wires into the passage so that each wire has its like forward end extending beyond the one end of the holder for mating, providing in spaced relation a pair of movable dies (36, 46), each die (36, 46) having an opening (38, 48) sized to receive, respectively, the end portions (18, 14) of the holder, positioning the first end portion (18) into opening (38), positioning the second end portion into the opening (48), and swaging the holder by movement of die (46) from the forward end of the passage along the entire length of the passage in an axial direction so that an outer wall portion of the holder is squeezed radially outwardly to form the retention collar medially of the holder end portions and so that an inner wall portion of the holder defining the axial passage is pushed radially inwardly to secure the wires within the passage.

2. The method as recited in claim 1, further comprising:

reducing the external diameter of shoulder portion (14) so as to provide a shoulder (42), and seating said second die (46) about said shoulder (42).

3. A method of making an electrical contact (10) of the type including a shoulder portion (14) formed with an axial passage (22), a termination portion (18), a retention collar (16) formed medially of the portions and several axial electrical conducting wires (24) formed into a bundle and mounted within the passage, the steps of the method comprising:

providing a pair of movable dies (36, 46) having openings (38, 48), respectively, sized to receive the termination portion (18) and the shoulder portion (14), positioning second die (46) above first die (36), inserting wires (24) into passage (22) so that like ends extend forwardly of shoulder portion (14), positioning termination portion (18) into opening (38) of die (36), positioning shoulder portion (14) into opening (48) of die (46), and swaging the shoulder portion (14) by movement of die (46) in an axial direction along the entire length of the passage so that the shoulder portion is deformed, deformation of the shoulder portion causing some of its outer wall to be pushed radially outwardly to form the retention collar and other of its outer wall defining the axial passage to be pushed radially inwardly to secure the wires within the passage, the retention collar so deformed having a diameter greater than the diameter of the other portions.

4. A method of making an elongated electrical contact (10) of the type including a cylindrical shoulder portion (14) formed with an axial passage (22) having a forward end portion (35) and a rear end portion (30), several electrical conducting wires (24) axially aligned and axially mounted within the passage and an elongated termination portion (18), said shoulder and termination portions (14, 18) being generally coaxial with each other and the diameter of the shoulder portion (14) being greater than the diameter of the termination portion (18), the steps of the method comprising: inserting the wires (24) into the passage (22) so that each of the wires have their forward end portions extending beyond the shoulder portion for mating, providing a first die member (36), said die member having means (38) for receiving said termination portion, providing a second die member (46), said second die member having means (48) for receiving said shoulder portion (14), said second die (46) being in spaced relation to said first die member (36) and each of said die members (36, 46) being movable towards one another, mounting the termination portion (18) into the first die member (36), seating the shoulder portion (14) into the receiving means (48) of said second die member (46), and squeezing the shoulder portion (14) from the forward end portion (35) of the passage (22) in an axial direction by moving said second die (46) towards said first die (36) so that an outer wall portion of the shoulder portion (14) is pushed axially towards the termination portion (18) and squeezed radially outward to form a retention collar medially of the shoulder and termination portions (14, 18) and so that an inner wall portion of the axial passage (22) is pushed radially inward and about the wires (22) to secure the wires within the passage, the diameter of the retention collar being greater than the diameter of either the shoulder portion (14) or of the termination portion (18).

5. A method of making an elongated electrical contact of the type including a medial retention collar (16), a cylindrical shoulder portion (14) formed with an axial passage (22), said passage having a forward end portion (35) and a rear end portion (30), several axial electrical conducting wires (24) mounted within the passage and having their forward ends (26) extending from the forward end of the passage for mating and a termination portion (18), the contact portions (14, 18) extending oppositely of the collar (16) and each being coaxial with the passage (22), the steps of the method comprising:

providing a pair of movable dies (36, 46), one of said dies (36) including an aperture (38) sized to receive the termination portion (18) and the other of said dies (46) including an opening (48) having a diameter slightly greater than the diameter of the shoulder portion (14) and adapted to seat about the shoulder portion (14) of the contact, axially aligning the opening (48) with the aperture (38), inserting the wires (24) into the passage (22), positioning the termination portion (18) into opening (38) of said one die (36), positioning the shoulder portion (14) into aperture (48) of said other die (46), and swaging the shoulder portion (14) by movement of die (46) from the forward end portion (35) of the passage (22) along the entire length of the passage toward the rear end portion (30) of the passage in an axial direction so that an outer wall portion of the shoulder portion (14) is both pushed axially towards the termination portion (18) and deformed radially outward to form the medial retention collar (16) and so that an inner wall portion of the shoulder portion (14) defining the axial passage (22) is deformed radially inward to secure the wires (24) within the passage.

6. The method as defined in claim 5 including the step of removing a circumferential layer (63) of the formed retention collar (16) whereby the outer circumferential surface of the collar and the electrical contact are coaxial.

7. The method as defined in claim 6 including the steps of:

removing said other die (46) and providing a trimming die (64) including a bore (66), positioning the swaged shoulder portion (14) into alignment with the bore prior to the step of removing the circumferential layer, said bore (66) having a diameter slightly larger than the outer diameter of cylindrical portion (39), and moving said trimming die (64) towards said one die (36) to thereby trim off the outer circumferential layer (63) of collar (16).

8. The method as defined in claim 7 wherein said step of removing circumferential layer (63) includes a step of cutting away the circumferential surface portion of the retention collar.

* * * * *